US008608673B2

(12) United States Patent
Cao

(10) Patent No.: US 8,608,673 B2
(45) Date of Patent: Dec. 17, 2013

(54) BATHTUB FOR BEAUTY AND HEALTH CARE AND A PHYSIC SOLUTION

(76) Inventor: Mengjun Cao, Shenzhen (CN)

( * ) Notice: Subject to any disclaimer, the term of this patent is extended or adjusted under 35 U.S.C. 154(b) by 436 days.

(21) Appl. No.: 12/994,151

(22) PCT Filed: Jul. 29, 2009

(86) PCT No.: PCT/CN2009/072978

§ 371 (c)(1),
(2), (4) Date: Nov. 23, 2010

(87) PCT Pub. No.: WO2010/133050

PCT Pub. Date: Nov. 25, 2010

(65) Prior Publication Data

US 2011/0072575 A1 Mar. 31, 2011

(30) Foreign Application Priority Data

May 20, 2009 (CN) ..... 2009 1 0107380

(51) Int. Cl.
*A61H 23/00* (2006.01)

(52) U.S. Cl.
USPC ..... 601/2; 601/158; 4/541.1

(58) Field of Classification Search
USPC ..... 601/2, 3, 15–18, 46, 49, 55–59, 61, 64, 601/69, 70, 75, 84, 86, 88, 96, 97, 101, 105, 601/107, 108, 111, 134, 136, 148, 150, 154, 601/155, 156, 158, 160, 161, 169; 4/539, 4/541.1, 541.3, 545; 607/81, 84, 85, 86, 607/87

See application file for complete search history.

(56) References Cited

U.S. PATENT DOCUMENTS

| | | | | |
|---|---|---|---|---|
| 5,339,804 | A * | 8/1994 | Kemp | 601/2 |
| 5,702,353 | A * | 12/1997 | Guzzini et al. | 601/2 |
| 5,896,596 | A * | 4/1999 | Murakami | 4/541.1 |
| 2007/0167882 | A1 * | 7/2007 | Guzzini | 601/3 |

OTHER PUBLICATIONS

International Search Report of PCT/CN2009/072978.

* cited by examiner

*Primary Examiner* — Quang D Thanh

(57) ABSTRACT

The present patent application provides a bathtub for beauty and health care and a physic solution. The bathtub comprises a housing and a tub which is formed by an inner tub and an outer tub nested together, there is a clearance between the inner tub and the outer tub, at least a group of ultrasonic generating elements are arranged on the wall of the outer tub and used for generating ultrasonic so as to vibrate water inside the outer tub and then vibrate physic solution inside the inner tub. Beauty and health care for a whole body can be realized by filling the physic solution into the inner tub, meanwhile, when a user is soaking in the physic solution, the physic solution is vibrated along with the ultrasonic generating elements, so that the physic solution can be introduced into the body effectively. In order to keep the temperature of the never goes too high or too low, a circulating pump is used to flow the physic solution circularly. Safe insulation effect is achieved by using hot water in the outer tub to heat the physic solution in the inner tub. The ultrasonic generating element can be controlled according to the actual situation and requirement of the user, and individual records and individual control for user can be realized, so that intelligent control performance of the bathtub for beauty and health care can be improved.

10 Claims, 4 Drawing Sheets

BATHTUB FOR BEAUTY AND HEALTH CARE AND A PHYSIC SOLUTION

CROSS REFERENCE TO RELATED APPLICATIONS

This application is a national phase application of PCT/CN2009/072978 which claims priority of Chinese patent application no. 200910107380.8 filed on May 20, 2009, the entire content of which is hereby incorporated by reference.

FIELD OF THE PATENT APPLICATION

The present patent application relates to a bathtub, and more particularly, to a bathtub for beauty and health care.

BACKGROUND

In existing products for beauty and health care, beauty and health care are always carried out on local parts of a human body. For example, whitening cosmetics are always used for facial beauty. However, with development of the times, when people presents various banquets, especially ladies always wear glad rags. Many glad rags are backless short skirt and most ladies care their dark skin colors, then embarrassing situations always occur. Accordingly, a product which may implement beauty and health care for a whole body is urgently demanded. In additional, when using existing products for beauty and health care to nurse a user, the physic solution is just used for coating or soaking, the effect of introducing physic solution into the skin is poor. A China utility model application No. 200920129563.5, titled "A BATHTUB FOR BEAUTY AND HEALTH CARE" has disclosed a bathtub which enhances the efficacy of the physic solution by using ultrasonic vibration. However, in that application, the health care efficacy of the physic solution is not desirable, and the physic solution in an inner tub should be heated by a heater, which results in electric leakage risks.

SUMMARY

One aspect of the present patent application is to provide a bathtub for beauty and health care, so as to solve the problems in prior art, such as the existing products for beauty and health care don't have function of beauty and health care for a whole body, and in a nursing process, the effect of introducing physic solution into the skin is poor.

According to the present patent application, a bathtub for beauty and health care is provided, comprising a housing and a tub which is formed by an inner tub and an outer tub nested together, and there is a clearance between the inner tub and the outer tub; at least a group of ultrasonic generating elements are arranged on the wall of the outer tub and used for generating ultrasonic wave so as to vibrate water inside the outer tub and then vibrate physic solution inside the inner tub; an inputting device is arranged on the housing, and a micro control processor and a storage device are arranged in the housing, wherein the inputting device is used to collect inputted vibration parameters, the storage device is used to store the vibration parameters, the micro control processor is used to access the vibration parameters sent by the inputting device or stored in the storage device so as to adjust frequency and power of the ultrasonic generating elements; a first circulating pump is arranged inside the housing for pumping hot water into the outer tub circularly, so as to keep temperature of the physic solution inside the inner tub between 35° C.~45° C.

In the bathtub for beauty and health care according to the present patent application, the bathtub for beauty and health care further comprises a first ultrasonic generating element arranged on the wall of the outer tub and used for ultrasonic massaging the rear back, a second ultrasonic generating element arranged on the wall of the outer tub and used for ultrasonic massaging the rear waist, a third ultrasonic generating element arranged on the wall of the outer tub and used for ultrasonic massaging the ventral and waist sides of the lower limb, a fourth ultrasonic generating element arranged on the wall of the outer tub and used for ultrasonic massaging the abdomen, a fifth ultrasonic generating element arranged on the wall of the outer tub and used for ultrasonic massaging the anterior chest, and a sixth ultrasonic generating element arranged on the housing and used for ultrasonic whitening and spraying massaging the face; wherein the sixth ultrasonic generating element is a portable ultrasonic sprayer, and a micro pump is arranged inside the housing for introducing the physic solution inside the inner tub out through the portable ultrasonic sprayer, so as to ultrasonic whitening and spraying massage the face.

In the bathtub for beauty and health care according to the present patent application, the portable ultrasonic sprayer further comprises a nozzle, a conduit connected with the nozzle, and the micro pump is connected with the conduit, an ultrasonic transducer is arranged in the nozzle.

In the bathtub for beauty and health care according to the present patent application, a first temperature controller is arranged on the wall of the outer tub for detecting and adjusting temperature of hot water inside the outer tub, the first temperature controller is electrically connected with the micro control processor; and/or a second temperature controller is arranged on the wall of the inner tub for detecting and adjusting the temperature of the physic solution inside the inner tub, the second temperature controller is electrically connected with the micro control processor.

In the bathtub for beauty and health care according to the present patent application, a second circulating pump is arranged inside the housing for circulating the physic solution inside the inner tub.

In the bathtub for beauty and health care according to the present patent application, a backrest frame is arranged at a backrest inclined wall of the inner tub, a plurality of axle tubes are arranged at regular intervals in the backrest frame, and each axle tube is coated with a silica gel coating.

In the bathtub for beauty and health care according to the present patent application, a seat frame is arranged at the bottom of the inner tub, a plurality of axle tubes are arranged at regular intervals in the seat frame, and each axle tube is coated with a silica gel coating.

In the bathtub for beauty and health care according to the present patent application, the bathtub for beauty and health care further comprises an external remote controller for sending controlling instructions to the micro control processor, and a drain valve for timed water draining is arranged in the housing and is electrically connected with the micro control processor.

According to another aspect of the present patent application, physic solution used for the bathtub for beauty and health care is provided, comprising in each 100 weight parts water:

| | |
|---|---|
| *Angelica* | 1~5 weight parts; |
| *Bletilla striata* | 1~5 weight parts; |

-continued

| | |
|---|---|
| Pearl powder nano-particles | 1~5 weight parts; |
| Vitamin mixture | 1~5 weight parts; |
| Other additive | 0~30 weight parts. |

In the physic solution according to the present patent application, the vitamin mixture comprises a vitamin A compound, a vitamin B compound, a vitamin C compound and a vitamin E compound; wherein the vitamin B compound comprises a mixture of one or more selected from a group of vitamin B1, vitamin B2, vitamin B3, vitamin B5, vitamin B6, vitamin B12 and folic acid.

In the physic solution according to the present patent application, the other additive comprises a mixture of one or more selected from a group of powder having function of relieving a depressed liver and regulating vital energy, powder having function of activating blood and dissolving stasis, and powder having function of eliminating dampness and resolving phlegm and having function of resolving hard and softening stones; wherein the powder having function of relieving a depressed liver and regulating vital energy comprises power of *bupleurum, cyperus rotundus L*, pericarpium citri reticulatae viride, fingered citron, trifoliate orange, *rosa rugosa*, green tangerine leaf, radix auckladiae and silktree albizia bark; the powder having function of activating blood and dissolving stasis comprises power of radix curcumae aromaticae, rhizoma chuanqiong, pangolin, semen vaccariae, rhizoma sparganii, *poria cocos, cassia* and *angelica*; the powder having function of eliminating dampness and resolving phlegm and having function of resolving hard and softening stones comprises *pinellia*, rhizoma arisaematis, white mustard, seaweed, kelp, *prunella*, radix scrophulariae, oyster, *poria* and *nux vomica*, and *sophora flavescens, cnidium monnieri*, borneol and catnip which are effective for skin sensitivity.

By implementing the bathtub for beauty and health care and the physic solution, the following technical effects can be achieved: beauty and health care for a whole body can be realized by filling the physic solution into the inner tub, meanwhile, when a user is soaking in the physic solution, the physic solution is vibrated by the ultrasonic generating elements, so that the physic solution can be introduced into the body effectively. In order to keep the temperature of the physic solution never goes too high or too low, a circulating pump is used to flow the physic solution circularly, then the temperature of the physic solution can be adjusted to be moderate and never go too high or too low. In additional, as the soaking process will be long in time, in order to avoid the temperature of the physic solution goes too low, heater elements are arranged inside the housing for heating when the temperature of the physic solution becomes low. Furthermore, an inputting device is arranged on the housing of the bathtub for beauty and health care, so that a user may control the ultrasonic generating elements and the heater according to the actual situation and requirement of the user. And by using the storage device, the setting parameters inputted from the inputting device by the user can be stored, so that individual records for users are realized, then an individual bathing control can be realized. Moreover, when a user is soaking in the physic solution, as the function of the ultrasonic wave, the whole body is evenly ultrasonic massaged, so that effects of body emaciating and weight reducing can be achieved.

BRIEF DESCRIPTIONS OF THE DRAWINGS

Hereinafter, embodiments of present patent application will be described in detail with reference to the accompanying drawings, wherein.

DETAILED DESCRIPTION OF THE INVENTION

Figure 1:
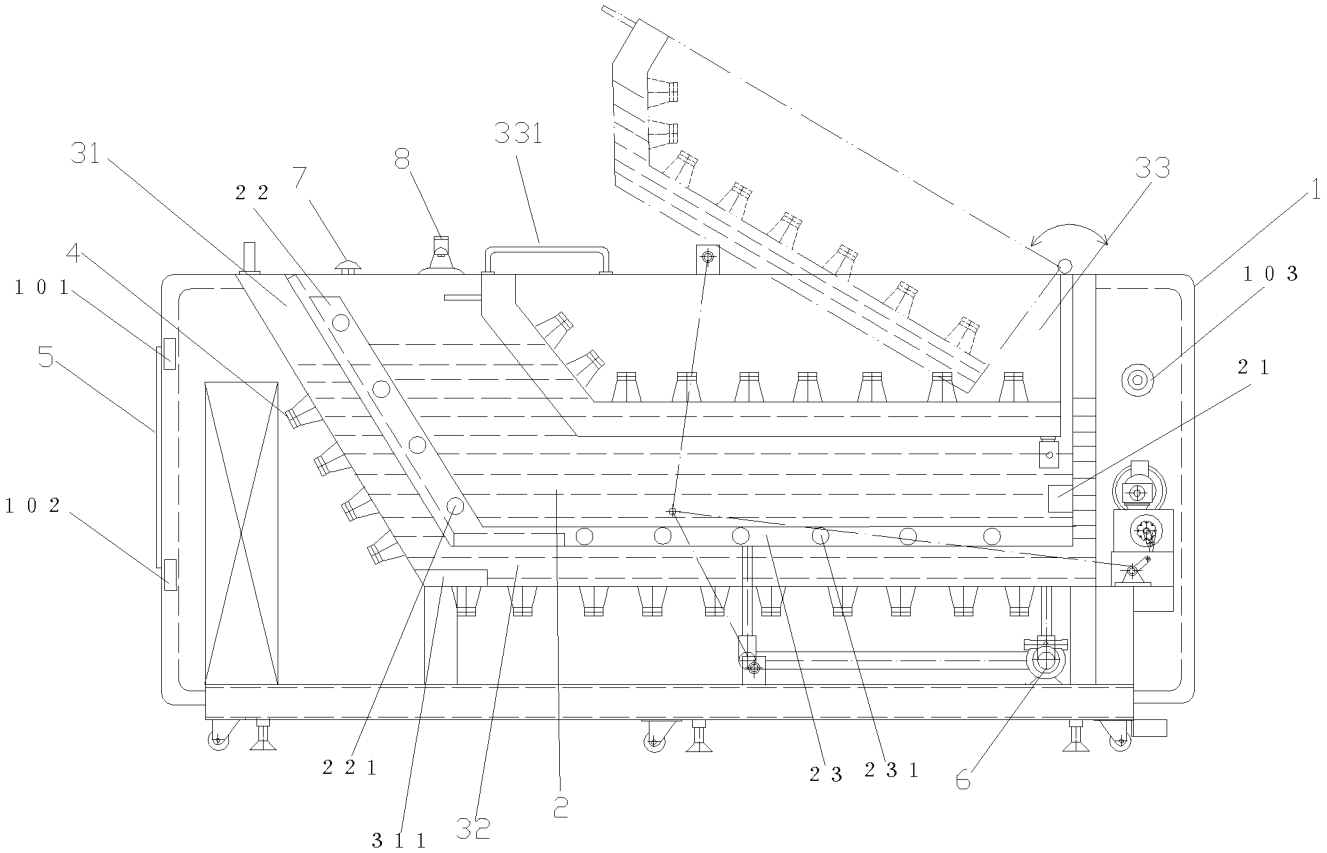
FIG. 1 is a structural diagram of an embodiment of a bathtub for beauty and health care according to the present patent application.
Figure 2:
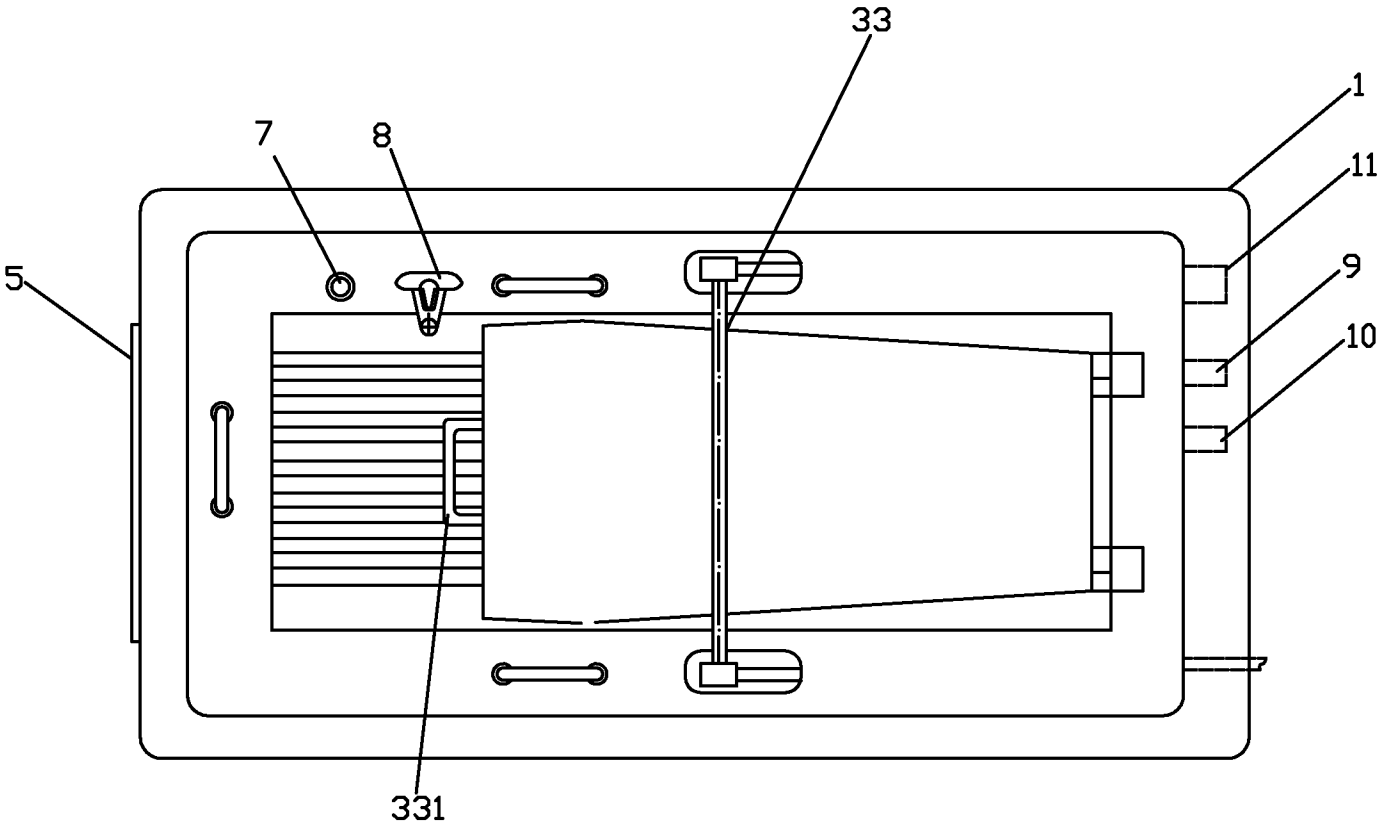
FIG. 2 is a top view of FIG. 1.

Referring to FIGS. 1 and 2, in an embodiment of the bathtub for beauty and health care according to the present invention, the bathtub for beauty and health care comprises a housing 1 and a tub which is formed by an inner tub 2 and an outer tub nested together, and there is a clearance between the inner tub and the outer tub. A group of ultrasonic generating elements are arranged on the wall of the outer tub and used for generating ultrasonic wave so as to vibrate water inside the outer tub and then vibrate physic solution inside the inner tub 2. An inputting device 5 is arranged on the housing 1. A micro control processor 101 and a storage device 102 are arranged in the housing, wherein the inputting device 5 is used to collect inputted vibration parameters, the storage device 102 is used to store the vibration parameters, the micro control processor 101 is used to access the vibration parameters sent by the inputting device or stored in the storage device 102, so as to adjust frequency and power of the ultrasonic generating elements.

Figure 4:
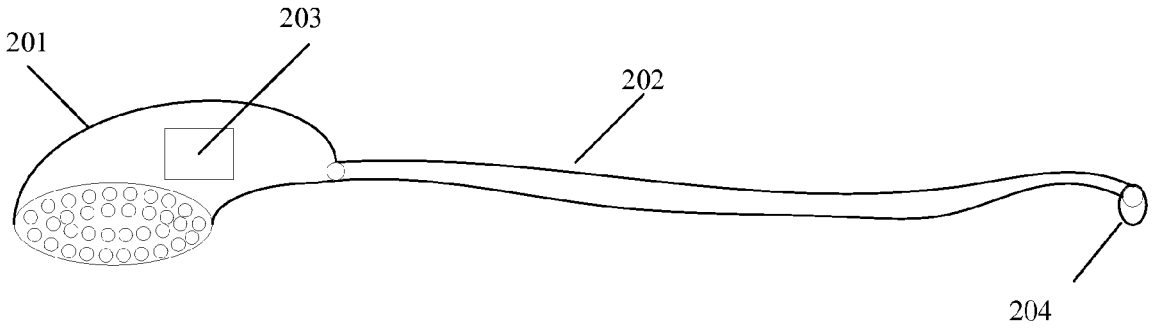
FIG. 4 is a structural diagram of a portable ultrasonic sprayer according to the present patent application.

In this embodiment, the housing 1 is a rectangular structure. For the design of the inner tub 2 and the outer tub, as users are usually sitting in the soaking process, the inner tub 2 mainly comprises a bottom, a backrest inclined wall and three side walls. The outer tub is designed to be a sandwich structure of the inner tub 2. That is, a backrest inclined wall sandwich 31 and a bottom sandwich 32 are formed at the outer side of the inner tub 2. A rotatable sandwich upper cover 33 is formed at an upper opening of the inner tub 2. In detailed design, a cross section of the sandwich upper cover 33 is formed by a right-angled trapezoid and a rectangle, wherein a low bottom edge of the right-angled trapezoid is shared with a width edge of the rectangle to form a pentagon shape. armrests 331 are arranged at the top of the pentagonal sandwich upper cover 33. The armrests 331 are functioned as to on the one hand make it convenient for opening and closing the sandwich upper cover 33 through rotation by hand, and on the other hand, to facilitate the user to hold the armrests 331 so as to adjust his/her sitting posture and position when the user is soaking in the bathtub. The implementation of rotation of the sandwich upper cover 33 is mainly realized by arranging a rotating shaft at one of its right-angled edge, so as to connect with the housing 1 though the rotating shaft. In this embodiment, the group of ultrasonic generating elements comprises a plurality of ultrasonic generating elements 4 arranged in the backrest inclined wall sandwich 31, a plurality of ultrasonic generating elements 4 arranged in the bottom sandwich 32, and a plurality of ultrasonic generating elements 4 arranged in the sandwich upper cover 33. These fixed ultrasonic generating elements 4 can be divided in to six segments according to their function. A first segment mainly acts on the rear back of a user soaking in the bathtub, a second segment mainly acts on the rear waist, a third segment mainly acts on the ventral and waist sides of the lower limb, the fourth segment mainly acts on the abdomen, the fifth segment mainly acts on the anterior chest, and the sixth segment mainly acts on the face. That is, a portable ultrasonic sprayer with low power is arranged in this embodiment, and a micro pump 204 is arranged inside the housing for introducing the physic solution inside the inner tub out through the portable ultrasonic sprayer, so as to ultrasonic whitening and spraying massage the face. The structure of the sprayer may be in the form of a household bath nozzle. As shown in FIG.4, the portable ultrasonic sprayer comprises a nozzle 201 and a conduit 202, wherein one end of the conduit 202 is connected with the nozzle 201, and the other end of the conduit 202 is connected with the micro pump 204, so that the physic solution can be pumped into the conduit 202, and then sprayed by the nozzle 201. In order to enhance massaging effect of the sprayer, an ultrasonic transducer 203 is arranged in the nozzle 201, so that when the nozzle 201 contacts with the face, vibration massaging effect is achieved, and then the whitening and health care effects to skin of the face by the physic solution can be enhanced. In detailed design, an ultrasonic transducer with lower power can be selected so as to achieve effects of safety and comfort, that is, power of the ultrasonic transducer is 5-15 W. When soaking in the physic solution, the user may hold the nozzle to massage the face, so as to introduce physic solution onto the face for whitening and nursing the face. In such design, for the fixed ultrasonic generating elements 4, power of each ultrasonic generating element is 60 W, and the ultrasonic frequency of each ultrasonic generating element is 25 KHz, 28 KHz, 35 KHz, 40 KHz or 100 KHz, and there are 100 ultrasonic generating elements in total. In additional, the clearance between the inner tub 2 and the outer tub can be 60 mm, 70 mm, 80 mm, 90 mm, 100 mm, 110 mm or 120 mm. In the operation process, the group of ultrasonic generating elements is controlled by the micro control processor 101, and then corresponding amounts of ultrasonic generating elements are started according to the setting, so as to satisfy requirements to the power and the frequency. Water in the outer tub will be driven to vibrate by the ultrasonic wave, and then, the vibration of water in the outer tub drives the wall of the inner tub 2 vibrating, then the physic solution in the inner tub 2 will be driven to vibrate by the vibration of the wall of the inner tub. Accordingly, in the soaking process, as the physic solution is vibrating which is helpful for introducing the physic solution into the human body, so the beauty and health care effect of the physic solution is enhanced. In the present invention, the physic solution can be a physic solution which can be used to whitening skin of the user, or other kind of physic solution for beauty and health care.

In design, a first circulating pump 103 may be arranged inside the housing 1 for pumping hot water outside into the outer tub circularly, so as to keep the physic solution inside the inner tub at a certain temperature, and then the physic solution inside the inner tub is heated by the hot water in the outer tub, so that the temperature of the physic solution inside the inner tub is kept between 35 ° C. ~45 ° C. A temperature controller 311 can be arranged on the wall of the outer tub for detecting and adjusting temperature of the hot water inside the outer tub. The temperature controller 311 is electrically connected with the micro control processor 101, so as to collect temperature of the outer tub sandwich in time, and further to adjust temperature of the outer tub sandwich. In a preferable embodiment, the temperature of the physic solution is kept between 35 ° C. ~45 ° C. by controlling temperature of hot water in the outer tub, in such a way, after the user soaks in the physic solution for a period of time, reduction of the nursing effect and uncomfortable feeling brought by the cooling of the physic solution can be avoided. In additional, a second temperature controller 21 is arranged on the wall of the inner tub for detecting temperature of the physic solution inside the inner tub in real time. The second temperature controller 21 is electrically connected with the micro control processor 101, so as to display the temperature of the physic solution inside the inner tub through the second temperature controller 21. Furthermore, for obtaining better heating effect, the outer tub sandwich isn't arranged at two sides of the inner tub 2, accordingly, heating elements can be arranged at the outer side of the two side walls of the inner tub 2. In detailed design, two heaters can be arranged symmetrically at the two sides. Heating power of each heater can be 5 KW, 10 KW, 15 KW or 20 KW. And there are four heaters in total. The heating elements can be activated by the control of the micro control processor 101, so as to heat the physic solution in the inner tub 2. Two sets of heating system can be used in the bathtub for beauty and health care according to the present invention for heating the physic solution in the inner tub, one of which is heating the physic solution in the inner tub by the circulation of hot water in the outer tub, the other one of which is heating the physic solution in the inner tub by the heating elements arranged at the two side walls of the inner tub, so that overall control for temperature of the physic solution in the inner tub can be realized.

As the bathtub for beauty and health care according to the present invention is used for beauty and health care for the whole human body, when a user is sitting in the inner tub 2 and against the inclined wall, the buttock and back of the body contact with litter physic solution, so that the nursing effects at the two positions are poor. Accordingly, a further inventive step of the present invention is that a backrest frame 22 and a seat frame 23 are arranged at the bottom and the inclined wall of the inner tub 2 respectively. In such a way, when a user is soaking in the physic solution, his/her buttock only contacts with the border of the seat frame 23, and the other parts of the buttock can contact with the physic solution sufficiently. Meanwhile, his/her back only contacts with the border of the backrest frame 22 and the other parts of the back can contact with the physic solution sufficiently. In additional, in another embodiment, it is taken into consideration that when a user is sitting or leaning, he/she will feel uncomfortable if he/she only contacts with the borders. Accordingly, in order to eliminate the defect that when a use is sitting or leaning, he/she can't contact with the physic solution sufficiently, and to provide comfort feelings meanwhile, a plurality of axle tubes 231 and 221 are arranged at regular intervals in the seat frame 23 and in the backrest frame 22 respectively, and each axle tube 221 and 231 is coated with a silica gel coating, so as to enhance the user's comfort feeling. In the soaking process, the user may hold the armrests 331 for adjusting the body position, so as to enable the other parts of the body to contact with the border of the backrest frame 22, the seat frame 23 and the axle tubes 221 and 231 in turn.

In each 100 weight parts water, the physic solution comprises: angelica of 1~-5 weight parts, bletilla striata of 1~-5 weight parts, pearl powder nano-particles of 1~-5 weight parts, vitamin mixture of 1~-5 weight parts, and other additive of 0~-30 weight parts. In a preferable embodiment, angelica of 2 weight parts, 3 weight parts or 4 weight parts is preferable, bletilla striata of 2 weight parts, 3 weight parts or 4 weight parts is preferable, and vitamin mixture of 2 weight parts, 3 weight parts or 4 weight parts is preferable.

In various embodiments, the vitamin mixture comprises a vitamin A compound, a vitamin B compound, a vitamin C compound and a vitamin E compound, wherein the vitamin A compound provides general requirement for physiological metabolism and growth of the skin; the vitamin B compound comprises a mixture of one or more selected from a group of vitamin B1, vitamin B2, vitamin B3, vitamin B5, vitamin B6, vitamin B12 and folic acid. Vitamin B1 mainly relates to energy production and metabolism of carbohydrate, fat and alcohol. Vitamin B2 plays a very important role in the formation process of enzyme for cell respiration. Meanwhile, Vitamin B2 also relates to energy production and metabolism of carbohydrate, fat and alcohol very nearly. Vitamin B3 is an important helper factor of enzyme for metabolism of glucose. Vitamin B6 plays a very important role in the metabolism of protein and amino acid. Meanwhile, vitamin B6 also takes part in the metabolism process of glucose, essential minerals and chemical substance (such as histamine and so on). Vitamin B12 is the only one vitamin which contains metal elements.

In order to further enhance health care effect for the soaking of the user, the other additive may be a mixture of one or more selected from a group of powder having function of relieving a depressed liver and regulating vital energy, powder having function of activating blood and dissolving stasis, and powder having function of eliminating dampness and resolving phlegm and having function of resolving hard and softening stones, wherein the powder having function of relieving a depressed liver and regulating vital energy comprises power of *bupleurum, cyperus rotundus L*, pericarpium citri reticulatae viride, fingered citron, trifoliate orange, *rosa rugosa*, green tangerine leaf, radix auckladiae and silktree albizia bark; the powder having function of activating blood and dissolving stasis comprises power of radix curcumae aromaticae, rhizoma chuanqiong, pangolin, semen vaccariae, rhizoma sparganii, *poria cocos, cassia* and *angelica*; the powder having function of eliminating dampness and resolving phlegm and having function of resolving hard and softening stones comprises *pinellia*, rhizoma arisaematis, white mustard, seaweed, kelp, *prunella*, radix scrophulariae, oyster, *poria* and *nux vomica*, and *sophora flavescens, cnidium monnieri*, borneol and catnip which are effective for skin sensitivity.

Figure 3:
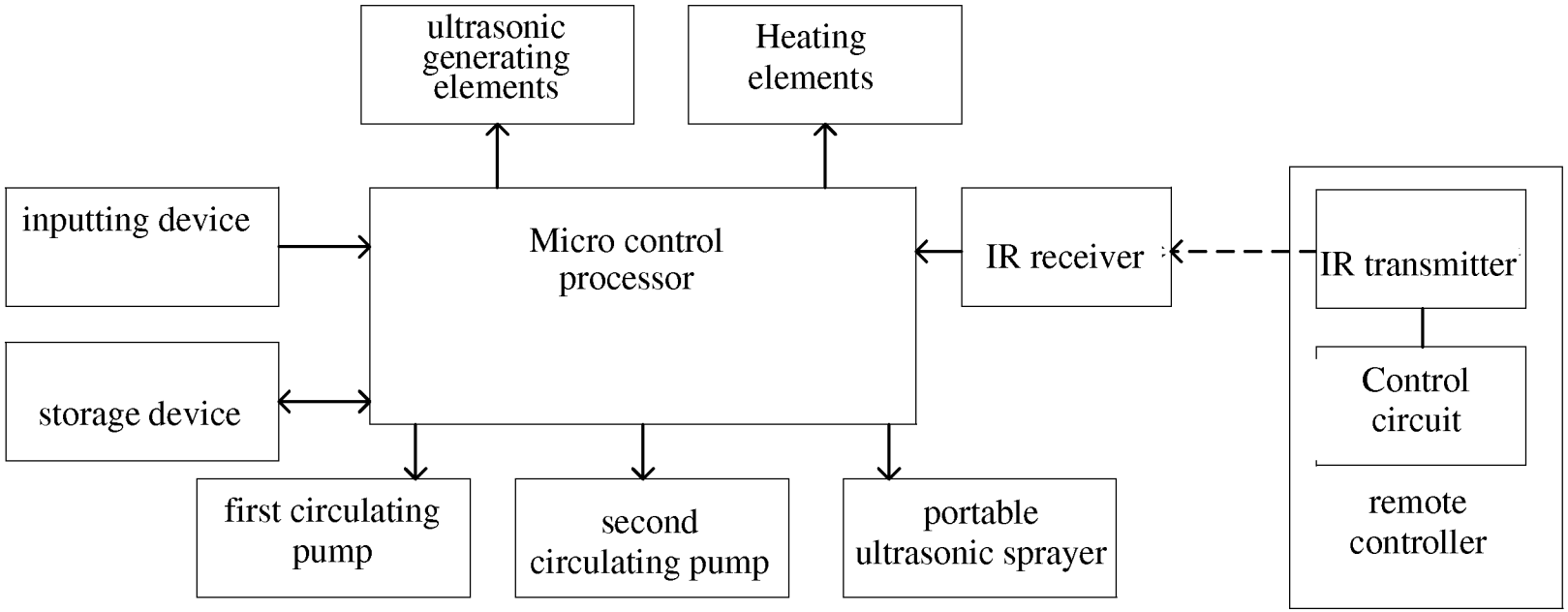
FIG. 3 is a circuit block diagram of the bathtub for beauty and health care shown in FIG. 1.

As shown in FIG.1, the inputting device 5 is arranged on a front panel of the housing 1. The inputting device 5 is designed to be an operation panel, on which keys and/or buttons are arranged. As shown in FIG.3, a user may send a corresponding setting signal to the micro control processor 101 inside the housing 1 through pressing the keys or adjusting the buttons. The micro control processor 101 receives the setting signal so as to control the bathtub for beauty and health care accordingly. The detailed control process can be activating water filling to the outer tub, and filling the inner tub 2 with the physic solution meanwhile; or setting frequency and power of the ultrasonic generating elements so as to satisfy the user's requirement, or activating the heating elements for heating the physic solution in the inner tub to a predefined temperature. Further, a storage device 102 is arranged in the housing 1, which can be used to store parameters set by the user through the inputting device 5. The parameters may be vibration parameters relating to the ultrasonic generating elements, also can be heating parameters relating to the heating elements, thus individual settings according to detailed requirements of different users can be achieved. When the user implements beauty nursing again, he/she needn't set each parameter again, and only need to activate the micro control processor 101, then the micro control processor 101 may access corresponding records from the storage device 102, and then beauty nursing can be implemented conveniently.

In additional, in the starting phase of user's soaking nursing, as the physic solution has a certain temperature in the one hand, and a certain amount of heat will be generated due to vibration of the physic solution driven by the ultrasonic generating elements on the other hand, situation that the temperature of the physic solution is too high will occur, which may affect the comfort feeling of the user's soaking Accordingly, a second circulating pump 6 is arranged inside the housing 1 for circulating the physic solution so as to avoid the situation that the temperature of the physic solution is too high. In additional, in order to enable the use to adjust in real time and conveniently in the process of soaking, the bathtub for beauty and health care is provided with an external remote controller, which is used to send related setting and adjusting commands to the micro control processor 101 through a IR transmitter. The micro control processor 101 implement an adjustment in real time after receiving the related commands through a IR receiver, so as to satisfy the user's requirement. As shown in FIG.1 and 2, an emergency switch 7 is arranged on the housing 1, so that when an emergency situation takes place, operation of the machine can be stopped by pressing the emergency switch to stop power supply. In additional, a cool water inlet 9 and a hot water inlet 10 are arranged on the housing 1 for adjusting concentration and temperature of the physic solution in the inner tub. An intake valve 8 is arranged to control the injection of water. Additionally, the inner tub 2 and the outer tub are each provided with a discharge outlet ll with a drain valve. When water is injected in and the user is soaking, the micro control processor 101 controls the drain valve being closed. In a preferable embodiment, a timer is integrated in the micro control processor 101. When injection of water is accomplished, the timer begins to time, and when the timing is reached, the micro control processor 101 will open the drain valve to discharge water automatically.

The ultrasonic bathtub for beauty and health care according to the present invention is based on the special physical function of "cavitation effect" when ultrasonic transmits in a liquid medium. Electrical power generated by the ultrasonic generating element can be transferred to ultrasonic power and radiated into the liquid medium through converse piezoelectric effect of the ultrasonic transducer. When the ultrasonic intensity is higher than the cavitation threshold of the cleaning medium, a lot of expanded cavities are rapidly produced in the cleaning medium due to the ultrasonic negative pressure. When in ultrasonic positive pressure, the cavities are violently compressed, cavities are blown up for reaching thousands of atmospheric pressures inside, so that microcosmic shock waves are formed and act on the skin surface of the body soaking inside the bathtub. Numberless expanded cavities are formed by ultrasonic negative pressure for tens of thousands times and numberless cavities are blown up by violently compression of ultrasonic positive pressure for tens of thousands times, then generate numberless microcosmic shock waves, that is, "cavitation effect". When using for beauty and health care for skin surface of the human body, the "cavitation effect" may eliminate microcosmic dirt and scurf on the surface of the skin, and enable the effective component of the physic solution for beauty and health care to be absorbed by the skin deeply and high effectively. The microcosmic shock wave produced by the "cavitation effect" has an overall massage function which can improve the unblocking and the microcirculation of the skin capillary, accelerating the activity and metabolism of the skin. Furthermore, the ultrasonic also has certain effects of sterilization and skincare. The bathtub for beauty and health care according to the present invention combines the characteristic of ultrasonic originally on the basis of an effective special medicine for whitening and heath care.

In the detailed design of the bathtub for beauty and health care, setting and controlling for ultrasonic parameters of beauty and health care can be implemented to back, chest, abdomen, waist, both lower limb ventral and face and so on. Angel between the backrest inclined wall of the inner tub 2 and the horizontal plane can be designed to be 30, 35, 40 or 45 degree inclined structure. The special upper and lower sandwich structure of the outer tub has realized even promulgation of the ultrasonic wave. The sandwich upper cover 33 is a structure design of a self-locked motor, a reducer, and a linkage transmission mechanism within an upper cover and an upper sandwich.

While the present invention has been described with reference to several embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A bathtub for beauty and health care, comprising a housing and a tub, wherein the tub is formed by an inner tub and an outer tub nested together, and there is a clearance between the inner tub and the outer tub; at least a group of ultrasonic generating elements are arranged on a wall of the outer tub and used for generating ultrasonic wave so as to vibrate water inside the outer tub and then vibrate physic solution inside the inner tub;

an inputting device is arranged on the housing, and a micro control processor and a storage device are arranged in the housing, wherein the inputting device is used to collect inputted vibration parameters, the storage device is used to store the vibration parameters, the micro control processor is used to access the vibration parameters sent by the inputting device or stored in the storage device so as to adjust frequency and power of the ultrasonic generating elements;

a first circulating pump is arranged inside the housing for pumping hot water into the outer tub circularly, so as to keep temperature of the physic solution inside the inner tub between 35° C. ~45° C.

2. The bathtub for beauty and health care according to claim 1, wherein the bathtub for beauty and health care further comprises a first ultrasonic generating element arranged on the wall of the outer tub and used for ultrasonic massaging a rear back of a user, a second ultrasonic generating element arranged on the wall of the outer tub and used for ultrasonic massaging the user's rear waist, a third ultrasonic generating element arranged on the wall of the outer tub and used for ultrasonic massaging the user's ventral and waist sides of a lower limb, a fourth ultrasonic generating element arranged on the wall of the outer tub and used for ultrasonic massaging the user's abdomen, a fifth ultrasonic generating element arranged on the wall of the outer tub and used for ultrasonic massaging the user's anterior chest, and a sixth ultrasonic generating element arranged on the housing and used for ultrasonic whitening and spraying massaging the user's face;

the sixth ultrasonic generating element is a portable ultrasonic sprayer, and a micro pump is arranged inside the housing for introducing the physic solution inside the inner tub out through the portable ultrasonic sprayer, so as to ultrasonic whitening and spraying massage the face.

3. The bathtub for beauty and health care according to claim 2, wherein the portable ultrasonic sprayer further comprises a nozzle, a conduit connected with the nozzle, and the micro pump is connected with the conduit, an ultrasonic transducer is arranged in the nozzle.

4. The bathtub for beauty and health care according to claim 2, wherein a first temperature controller is arranged on the wall of the outer tub for detecting and adjusting temperature of hot water inside the outer tub, the first temperature controller is electrically connected with the micro control processor; and/or a second temperature controller is arranged on the wall of the inner tub for detecting and adjusting the temperature of the physic solution inside the inner tub, the second temperature controller is electrically connected with the micro control processor.

5. The bathtub for beauty and health care according to claim 2, wherein a second circulating pump is arranged inside the housing for circulating the physic solution inside the inner tub; and the bathtub for beauty and health care further comprises an external remote controller for sending controlling instructions to the micro control processor, and a drain valve for timed water draining is arranged in the housing and is electrically connected with the micro control processor.

6. The bathtub for beauty and health care according to claim 2, wherein a backrest frame is arranged at a backrest inclined wall of the inner tub, a plurality of axle tubes are arranged at regular intervals in the backrest frame, and each axle tube is coated with a silica gel coating.

7. The bathtub for beauty and health care according to claim 2, wherein a seat frame is arranged at a bottom of the inner tub, a plurality of axle tubes are arranged at regular intervals in the seat frame, and each axle tube is coated with a silica gel coating.

8. Physic solution used in a bathtub for beauty and health care according to claim 1, wherein in each 100 weight parts water, the physic solution comprises:

| | |
|---|---|
| *Angelica* | 1~5 weight parts; |
| *Bletilla striata* | 1~5 weight parts; |
| Pearl powder nano-particles | 1~5 weight parts; |
| Vitamin mixture | 1~5 weight parts; |
| Other additive | 0~30 weight parts. |

9. The physic solution according to claim 8, wherein the vitamin mixture comprises a vitamin A compound, a vitamin B compound, a vitamin C compound and a vitamin E compound; wherein the vitamin B compound comprises a mixture of one or more selected from a group of vitamin B1, vitamin B2, vitamin B3, vitamin B5, vitamin B6, vitamin B12 and folic acid.

10. The physic solution according to claim 8, wherein the other additive comprises a mixture of one or more selected from a group of powder having function of relieving a depressed liver and regulating vital energy, powder having function of activating blood and dissolving stasis, and powder having function of eliminating dampness and resolving phlegm and having function of resolving hard and softening stones;

wherein the powder having function of relieving a depressed liver and regulating vital energy comprises power of *bupleurum, cyperus rotundus L*, pericarpium citri reticulatae viride, fingered citron, trifoliate orange, *rosa rugosa*, green tangerine leaf, radix auckladiae and silktree albizia bark; the powder having function of activating blood and dissolving stasis comprises power of radix curcumae aromaticae, rhizoma chuanqiong, pangolin, semen vaccariae, rhizoma sparganii, *poria cocos, cassia* and *angelica*; the powder having function of eliminating dampness and resolving phlegm and having function of resolving hard and softening stones comprises *pinellia*, rhizoma arisaematis, white mustard, seaweed, kelp, *prunella*, radix scrophulariae, oyster, *poria* and *nux vomica*, and *sophora flavescens, cnidium monnieri*, borneol and catnip which are effective for skin sensitivity.

* * * * *